US007121928B2

(12) United States Patent
Takashima et al.

(10) Patent No.: US 7,121,928 B2
(45) Date of Patent: Oct. 17, 2006

(54) HIGH SMOOTHNESS GRINDING PROCESS AND APPARATUS FOR METAL MATERIAL

(75) Inventors: Kazuhiko Takashima, Yokohama (JP); Minoru Ota, Kanagawa (JP); Manabu Wakuda, Kanagawa (JP); Tatsuomi Nakayama, Kanagawa (JP); Hidenori Watanabe, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 11/067,757

(22) Filed: Mar. 1, 2005

(65) Prior Publication Data

US 2005/0197051 A1 Sep. 8, 2005

(30) Foreign Application Priority Data

Mar. 2, 2004 (JP) ..... 2004-057244

(51) Int. Cl.
*B24B 1/00* (2006.01)

(52) U.S. Cl. ..... 451/49; 451/51

(58) Field of Classification Search ..... 451/28, 451/41, 49, 51, 57, 58
See application file for complete search history.

(56) References Cited

U.S. PATENT DOCUMENTS

| | | | | |
|---|---|---|---|---|
| 4,984,390 | A * | 1/1991 | Kobayashi | 451/443 |
| 6,447,376 | B1 * | 9/2002 | Ohmori et al. | 451/72 |
| 2003/0050000 | A1 * | 3/2003 | Nonogawa et al. | 451/544 |

FOREIGN PATENT DOCUMENTS

JP 2003-094296 A 4/2003

OTHER PUBLICATIONS

Japanese Industrial Standard, "Carbon Steels for Machine Structural Use", JIS G 4051, 1979, pp. 2-.

* cited by examiner

*Primary Examiner*—Jacob K. Ackun, Jr.
(74) *Attorney, Agent, or Firm*—Foley & Lardner LLP

(57) ABSTRACT

A high smoothness grinding process for obtaining a highly smooth surface of a metal material member. The process includes grinding an outer peripheral surface of a cylindrical or generally cylindrical metal material member by using a super abrasive grain grinding wheel in a condition in which a value [a peripheral speed of the grinding wheel/a peripheral speed of the metal material member] is not larger than 100, the grinding serving as a main grinding step.

14 Claims, 3 Drawing Sheets

HIGH SMOOTHNESS GRINDING PROCESS AND APPARATUS FOR METAL MATERIAL

BACKGROUND OF THE INVENTION

This invention relates to improvements in high smoothness grinding process and apparatus for metal materials, and more particularly to the high smoothness grinding process and apparatus for making a surface of the metal material highly smooth by using a super abrasive grain grinding wheel.

In order to obtain a highly smooth surface of a metal material by machining, hitherto a grinding step and a lapping (super-finishing) step are carried out as a grinding process for the metal material, or otherwise a rough grinding and a finish grinding step (plural steps of grindings) are carried out as a grinding process for the metal material.

In such grinding processes, it is required to transfer the metal material or workpiece from one grinding device to another grinding device every time a step is changed into another step. This prolongs a machining time for the workpiece and increases the number of steps and machining devices, thereby raising a machining cost. As a result, it is desired and proposed to obtain a highly smooth surface at only a single step by employing a plunge grinding, as disclosed in Japanese Patent Provisional Publication No. 2003-94296.

SUMMARY OF THE INVENTION

However, difficulties have been encountered in the above conventional technique, in which a machining time is largely prolonged.

It is, therefore, an object of the present invention to provide an improved high smoothness grinding process and apparatus by which drawbacks encountered in conventional techniques for obtaining a highly smooth surface of a metal material (workpiece) can be effectively overcome.

Another object of the present invention is to provide improved high smoothness grinding process and apparatus by which a highly smooth surface of a metal material (workpiece) can be obtained at a high machining accuracy under a short machining time.

A further object of the present invention is to provide improved high smoothness grinding process and apparatus by which the difference between the peripheral speed of a grinding wheel and the peripheral speed of a workpiece is maintained constant.

An aspect of the present invention resides in a high smoothness grinding process which comprises grinding an outer peripheral surface of a cylindrical or generally cylindrical metal material member by using a super abrasive grain grinding wheel in a condition in which a value [a peripheral speed of the grinding wheel/a peripheral speed of the metal material member] is not larger than 100, the grinding serving as a main grinding step.

Another aspect of the present invention resides in a high smoothness grinding apparatus comprising a super abrasive grain grinding wheel for grinding a metal material member as a workpiece. A grinding wheel driving device is provided to rotationally drive the grinding wheel. A workpiece driving device is provided to rotationally drive the metal material member. Additionally, a peripheral speed control device is provided to be adapted to control a value [a peripheral speed of the grinding wheel/a peripheral speed of the metal material member] within a range of from 10 to 100.

DETAILED DESCRIPTION OF THE INVENTION

Figure 1:
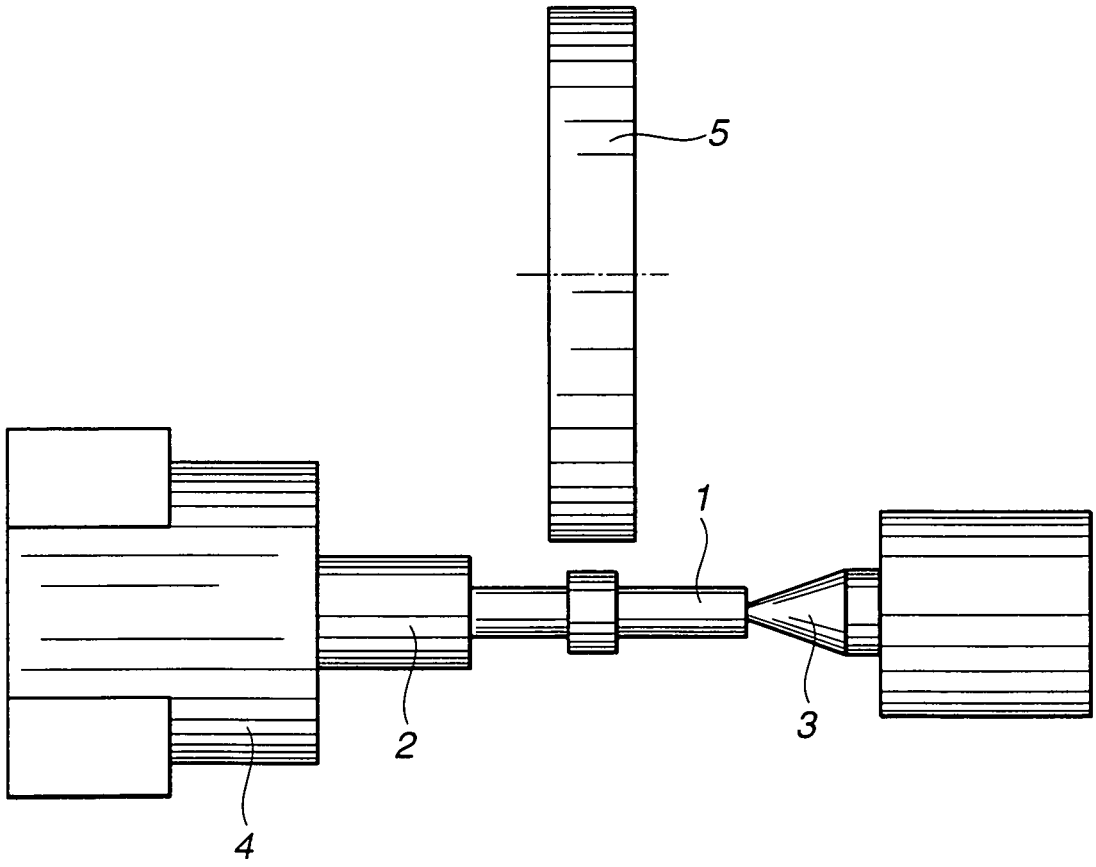
FIG. 1 is a schematic illustration of an embodiment of a high smoothness grinding apparatus for accomplishing a high smoothness grinding process according to the present invention under a plunge grinding.

According to the present invention, a high smoothness grinding process comprises grinding an outer peripheral surface of a cylindrical or generally cylindrical metal material member (workpiece) by using a super abrasive grain grinding wheel in a condition in which a value [a peripheral speed of the grinding wheel/a peripheral speed of the metal material member] is not larger than 100, the grinding serving as a main grinding step. The metal material member means a member made of metal (material).

With the above grinding process, a depth of cut per one rotation of the workpiece is suppressed small, and therefore the grinding wheel can be prevented from being welded to the surface of the workpiece under the influence of grinding heat thereby accomplishing a high efficient grinding. Additionally, the grinding heat can be prevented from being transmitted to the workpiece thereby suppressing formation of a work affected layer.

In the above grinding process, it is preferable that the value of the peripheral speed of the grinding wheel/the peripheral speed of the workpiece is within a range of from 10 to 100. This is because the rotational speed of the workpiece is too high to accomplish grinding of the workpiece if the value of the peripheral speed of the grinding wheel/the peripheral speed of the workpiece is less than 10. Further, it is preferable that the peripheral speed of the grinding wheel is not lower than 120 m/s, for example, within a range of from 120 to 350 m/s. If the peripheral speed is lower than 120 m/s under the present conditions, a grinding resistance becomes high thereby making it impossible to accomplish a high efficient grinding. If the peripheral speed of the grinding wheel exceeds 350 m/s, removal of abrasive, breakage of the grinding wheel, and the like will tend to occur. If both the peripheral speeds of the workpiece and the grinding wheel become high, an amount of the workpiece left uncut during grinding tends to become small, and therefore a machining time of accomplishing "spark out" step can be sharply shortened while a deformation amount of the workpiece can become small thereby improving a working precision.

The supper abrasive grain grinding wheel is formed of abrasive grains having a mean grain size of preferably not smaller than 40 μm, more preferably within a range of from 60 to 400 μm. If the mean grain size is smaller than 40 μm, a force for retaining the abrasive grains is lowered, so that the abrasive grains tend to fall off.

It will be understood that the grinding process of the present invention is preferably used for a high efficiency grinding at a grinding stock removal rate of not higher than 20 $mm^3$/mm·s.

In the above grinding process, it is preferable that the a cutting speed of the grinding wheel is lowered stepwise. This is because a roughness of ground surface and a work affected layer tend to become large if the cutting speed (or grinding stock removal rate) is abruptly increased. More specifically, a finish grinding step at a relatively small cutting speed is added, so that grinding of the workpiece is accomplished at at least two (step) cutting speeds (i.e., a rough or main grinding step and the finish grinding step) thereby finally providing a highly smooth grinding surface having a small work affected layer. The peripheral speed of the grinding wheel at the finish grinding step is preferably smaller than that at the rough grinding step. Under a condition where the grinding stock removal rate is lower, the grinding heat generated during the grinding is relatively small thereby providing a small thermal influence to the workpiece. Accordingly, by making low both the peripheral speeds of the grinding wheel and the workpiece, the thermal influence can be further minimized. Additionally, an influence of unbalance in centrifugal forces of rotations of the grinding wheel and the workpiece can be minimized thereby providing a high accuracy and high smoothness surface to the work piece.

A "spark out" step is accomplish after either one of the main grinding step and the finish grinding step, or after both the main grinding step and the finish grinding step. It is difficult to obtain a highly smooth surface only by a grinding step at a high cutting speed; however, such a highly smooth surface can be obtained with a short cutting time by accomplishing the spark out. It is particularly preferable that the grinding process includes at least three steps such as the main grinding step, the finish grinding step and the spark out step. The "spark out" means a machining where the grinding wheel is run over the workpiece without increasing the depth of cut till sparks die out, or grinding is made without cutting.

It is also preferable to accomplish the grinding while at least one of the super abrasive grain grinding wheel and the workpiece (metal material member) is swung in an axial direction of the grinding wheel which direction is perpendicular to a direction in which the cutting is made. By cutting or spark out is made by the grinding wheel while the grinding wheel and/or workpiece are swung, a further high smoothness surface can be obtained. It will be understood that speed and width of swinging movement of the grinding wheel and/or the workpiece are suitably set according to the workpiece.

The super abrasive grain grinding wheel is formed of abrasive grains of at least one of CBN (cubic boron nitride) and diamond. The abrasive grains have a mean grain size ranging from 60 to 400 μm and are bonded to each other with a bonding material such as vitrified bond to form the super abrasive grain grinding wheel. The grinding wheel is high in abrasive grain strength by using such abrasive grains bonded with such a bonding material. The vitrified bond is high in bonding strength, and therefore dressing is hardly required. Further, the grinding wheel has many chip pockets at its working surface, so that clogging of the chip pockets hardly occur.

The super abrasive grain grinding wheel is preferably flattened by dressing using a dresser, as one step in the grinding process. As the dresser, a rotary dresser formed of diamond abrasive grains whose mean grain size is larger than that of the abrasive grains of the super abrasive grain grinding wheel. In the dressing, a dressing lead in downcut is set at a value of not larger than 0.1 mm/r.o.w. (per one revolution of the grinding wheel), and a depth of cut is set at a value of not larger than 5 μm/pass. The "pass" means one stroke of the dresser along the axial direction of the grinding wheel to be dressed, so that the dresser is moved across the working surface of the grinding wheel in the axial direction of the grinding wheel by one time per one "pass" of the dresser. By accomplishing such a downcut dressing of the grinding wheel by using the dresser having the diamond abrasive grains which are larger in mean grain size than the abrasive grains of the grinding wheel, micro-facture of the abrasive grains of the grinding wheel is promoted so as to minimize the area of flank of cutting edges formed at the working or grinding surface of the grinding wheel thereby improving a cutting quality of the grinding wheel. In the above dressing or flattening step, it is preferable that a value of a peripheral speed of the dresser/a peripheral speed of the grinding wheel is within a range of from 0.6 to less than 1.0; the dressing lead is within a range of from 0.01 to 0.1 mm/r.o.w.; and the depth of cut is not larger than 5 μm/pass. Thus, by increasing the value of the peripheral speed of the dresser/the peripheral speed of the grinding wheel and decreasing the dressing lead, degradation of the cutting quality can be suppressed thereby achieving a high smoothness grinding. Furthermore, the dresser is preferably a so-called single-point dresser or a so-called V-type dresser. By using such dressers, stable dressing becomes possible thereby accomplishing a high smoothness grinding which provides a highly smooth surface low in roughness irregularity.

Next, a high smoothness grinding apparatus for a metal material member (workpiece), according to the present invention will be discussed.

The grinding apparatus comprises the super abrasive grain grinding wheel which is rotatably driven by a grinding wheel driving device. A workpiece driving device is provided to rotatably drive the workpiece or metal material member. Additionally, a peripheral speed control device is provided to control the grinding wheel driving device and/or the workpiece driving device in such a manner that the value of the grinding wheel peripheral speed/the workpiece peripheral speed is regulated within a range of from 10 to 100. With this grinding apparatus, a surface of the workpiece can be grinded at a high efficiency to obtain a highly smooth surface of the workpiece.

In the grinding apparatus, the super abrasive grain grinding wheel may be rotatably supported through a magnetic bearing or a fluid bearing. The magnetic bearing can actively control the action of the grinding wheel. The fluid bearing is high in rotational accuracy and can damp vibration of the grinding wheel. By using either one of the magnetic or fluid bearings, the workpiece can be ground to obtain a high precision and high smoothness surface.

The grinding apparatus is further provided with a swinging device which causes at least one of the super abrasive grain grinding wheel and the workpiece (metal material member) to swing in an axial direction of the grinding wheel which direction is generally perpendicular to a direction in which the cutting is made. The super abrasive grain grinding wheel is formed of abrasive grains of at least one of CBN (cubic boron nitride) and diamond. The abrasive grains have a mean grain size ranging from 60 to 400 μm and are bonded to each other with a bonding material such as vitrified bond to form the super abrasive grain grinding wheel. The grinding wheel is high in abrasive grain strength by using such abrasive grains bonded with such a bonding material. The vitrified bond is high in bonding strength, and therefore dressing is hardly required. Further, the grinding wheel has many chip pockets at its working surface, so that clogging of the chip pockets hardly occur.

The grinding apparatus is preferably furthermore provided with a dresser to flatten the working or grinding surface of the grinding wheel. By this dresser, micro-facture of the abrasive grains of the grinding wheel is promoted so as to minimize the area of flank of cutting edges formed at the working or grinding surface of the grinding wheel thereby improving a cutting quality of the grinding wheel.

It is preferable to support the workpiece at its rotational center by using a rotatable center, by which the workpiece can be turned at a high speed thereby accomplishing grinding of the workpiece at a high efficiency to obtain a highly smooth surface.

EXAMPLES

The present invention will be more readily understood with reference to the following Examples in comparison with Comparative Example; however, these Examples are intended to illustrate the invention and are not to be construed to limit the scope of the invention.

Example 1

An example of the high smoothness grinding apparatus used for carrying out the high smoothness grinding process is shown in FIG. 1.

The grinding apparatus included balanced chuck 2 and rotatable center 3 between which cylindrical workpiece 1 was supported in such a manner that workpiece 1 was turned upon rotational driving of an electric motor (not shown). The electric motor was connected to main shaft 4 to which balanced chuck 2 is connected. Rotating grinding wheel 5 was brought into contact with workpiece 1 in a manner of plunge grinding so as to grind workpiece 1. Workpiece 1 was formed of a machine structural carbon steel ("S45C" according to Japanese Industrial Standard JIS G 4051). Grinding wheel 5 was formed of abrasive grains of CBN having a grain size of number 80, bonded with vitrified bond.

Figure 2A:
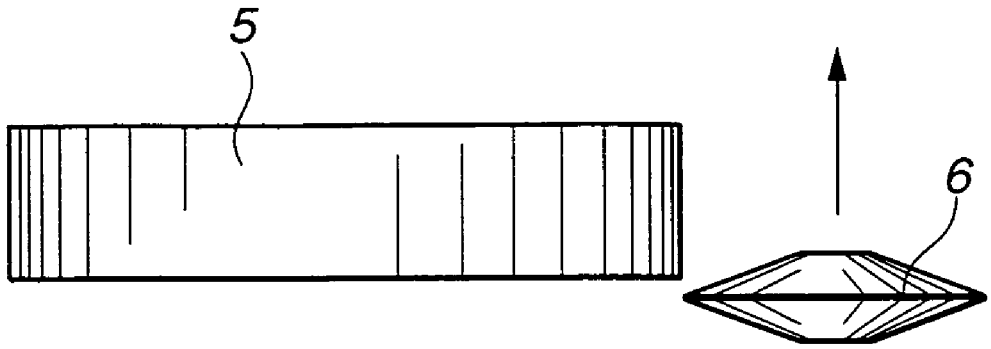
FIG. 2A is a schematic front illustration showing a manner of dressing for a grinding wheel to be used in the grinding apparatus of FIG. 1.
Figure 2B:
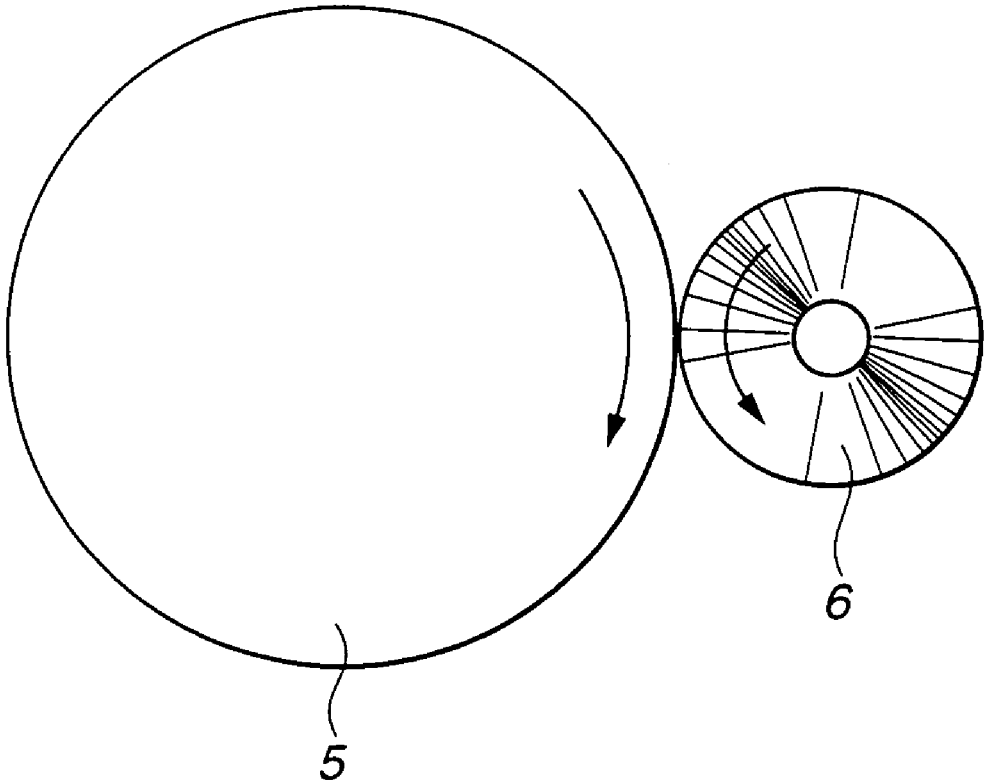
FIG. 2B is a schematic plan illustration showing the manner of dressing of FIG. 2A.

Dressing was accomplished on grinding wheel 5 before grinding of the workpiece is made, in a manner as shown in FIGS. 2A and 2B.

Rotating rotary dresser 6 was cut into rotating grinding wheel 5 in a manner of traverse grinding thereby accomplishing dressing for the grinding wheel. Rotary dresser 6 was a diamond rotary dresser formed of diamond abrasives having a grain size of number 40. Conditions of the dressing was as follows: The peripheral speed of grinding wheel 5 was 200 m/s; The peripheral speed of dresser 6 was 160 m/s (the dresser peripheral speed/grinding wheel peripheral speed=0.8); the dressing lead was 0.01 mm/r.o.w.; and the depth of cut of dresser 6 was 2 μm/pass.

Figure 3:
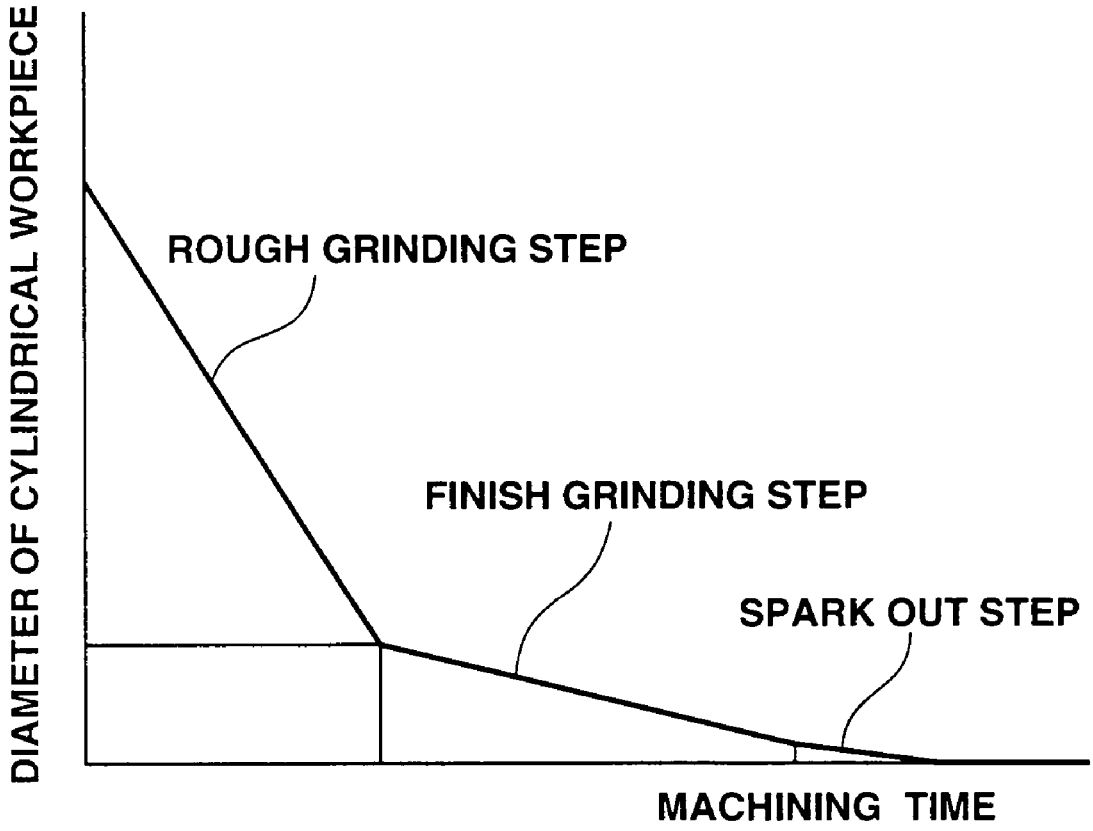
FIG. 3 is a graph showing an example of manner for carrying out the high smoothness grinding process of the present invention including a rough grinding step, a finish grinding step and a spark out step.

The high smoothness grinding process for the workpiece was conducted in a control manner as illustrated in FIG. 3.

As the high smoothness grinding process, a rough (main) grinding step in which a depth of grinding (depth of cut) of grinding wheel or tool 5 was relatively large to workpiece 1, and a finish grinding step in which the depth of cut of grinding wheel 5 was relatively small to workpiece 1, and a spark out step were accomplished. In the grinding process, the peripheral speed of grinding wheel 5 was 200 m/s as same as the grinding wheel peripheral speed at the dressing step. The peripheral speed of workpiece 1 was 3.3 m/s (the grinding wheel peripheral speed/the workpiece peripheral speed=60). Throughout the grinding process, the grinding wheel peripheral speed was constant, and the workpiece peripheral speed was constant. A grinding stock removal rate was 6.3 $mm^3$/mm·s.

At the rough grinding step, grinding was made under a condition in which the depth of cut of the grinding wheel per one revolution of workpiece 1 was 1.9 μm/rev. Since the peripheral speed of workpiece 1 was relatively high, the depth of cut per one revolution of workpiece 1 was made relatively small even though the grinding stock removal rate (or cutting speed) was relatively high, so that the influence of grinding heat was relatively small. As a result, a surface which was relatively small in work affected layer and in ground surface roughness could be obtained thereby reducing an amount of workpiece 1 to be removed at the finish grinding step.

Subsequently, the finish grinding in which the depth of cut was relatively small was accomplished in a condition where the depth of cut was set at 0.06 μm/rev., in which the grinding stock removal rate was 0.21 $mm^3$/mm·s.

Additionally, the spark out (grinding) step was accomplished in a condition where the depth of cut was zero, thereby improving a ground surface roughness and a dimensional accuracy of work piece 1. This spark out step may not be accomplished according to grinding accuracy and time.

As illustrated in FIG. 3, the diameter of cylindrical workpiece 1 was reduced as the grinding process proceeds from the rough grinding step through the finish grinding step to the spark out step.

Example 2

A procedure of Example 1 was repeated to carry out a high smoothness grinding process of this Example by using a grinding apparatus as shown in FIG. 1, except for the following points: At the rough (main) grinding step, the peripheral speed of workpiece 1 was 2 m/s, and the depth of cut was 3.1 μm/rev (the grinding stock removal rate was the same as in Example 1). In other words, the value of the peripheral speed of the grinding wheel/the peripheral speed of the workpiece was 100.

Also in this Example, the depth of cut per one revolution of workpiece 1 was made relatively small, and therefore the influence of grinding heat was relatively small, thereby providing a smooth surface having no work affected layer.

Example 3

A procedure of Example 1 was repeated to carry out a high smoothness grinding process of this Example by using a grinding apparatus as shown in FIG. 1, except for the fact that the peripheral speeds of grinding wheel 5 and workpiece 1 at the finish grinding step were different respectively from those at the rough grinding step.

Specifically, as the high smoothness grinding process, a rough (main) grinding step in which both the peripheral speeds of grinding wheel 5 and workpiece 1 were relatively high, and a finish grinding step in which both the peripheral speeds of grinding wheel 5 and workpiece 1 were respectively lower than those at the rough grinding step, and a spark out step were accomplished. At the finish grinding step, the peripheral speed of grinding wheel 5 was 120 m/s, and the peripheral speed of workpiece 1 was 0.2 m/s (the grinding wheel peripheral speed/the workpiece peripheral speed=600). The rough grinding step and the spark out step were respectively the same as those in Example 1.

Since the grinding stock removal rate at the finish grinding step was relatively low, welding of the workpiece to the working surface of the grinding wheel due to grinding heat did not occur. As a result, the ground surface roughness became smaller than that in Example 1 since the value of the grinding wheel peripheral speed/the workpiece peripheral speed became larger than that in Example 1. Additionally, both the peripheral speeds of grinding wheel 5 and workpiece 1 became smaller than those in Example 1, and therefore an amount of unbalance due to respective centrifugal forces of them were largely reduced as compared with that in Example 1 so that workpiece 1 could be grinded at a high accuracy. However, the machining time for the workpiece became long as compared with that in Example 1.

Comparative Example

A procedure of Example 1 was repeated to carry out a grinding process of this Comparative Example by using a grinding apparatus as shown in FIG. 1, except for the fact that the peripheral speed of the workpiece was 1 m/s, and the depth of cut was 6.3 μm/rev (the grinding stock removal rate was the same as in Example 1). Accordingly, the value of the peripheral speed of the grinding wheel/the peripheral speed of the workpiece became 200.

Since the depth of cut was required to be set larger at the same grinding stock removal rate, the influence of grinding heat was relatively large in this Comparative Example. As a result, the surface roughness of the ground workpiece was degraded as compared with that in Examples.

As appreciated from the above, according to the present invention, the high smoothness grinding process comprises grinding the outer peripheral surface of the cylindrical or generally cylindrical metal material member (workpiece) by using the super abrasive grain grinding wheel in the condition in which the value [a peripheral speed of the grinding wheel/a peripheral speed of the metal material member] is not larger than 100, the grinding serving as a main grinding step. Accordingly, the depth of cut per one rotation of the workpiece is suppressed small, and therefore the grinding wheel can be prevented from being welded to the surface of the workpiece under the influence of grinding heat thereby accomplishing a high efficient grinding. Additionally, the grinding heat can be prevented from being transmitted to the workpiece thereby suppressing formation of the work affected layer.

The entire contents of Japanese Patent Application P2004-057244 (filed Mar. 2, 2004) are incorporated herein by reference.

Although the invention has been described above by reference to certain embodiments and examples of the invention, the invention is not limited to the embodiments and examples described above. Modifications and variations of the embodiments and examples described above will occur to those skilled in the art, in light of the above teachings. The scope of the invention is defined with reference to the following claims.

What is claimed is:

1. A high smoothness grinding process, comprising:

grinding an outer peripheral surface of a cylindrical or generally cylindrical metal material member by using a super abrasive grain grinding wheel in a condition in which a value of a peripheral speed of the grinding wheel/a peripheral speed of the metal material member is not larger than 100, wherein the grinding step serves as a main grinding step.

2. A high smoothness grinding process as claimed in claim 1, wherein the value of the peripheral speed of the grinding wheel/the peripheral speed of the metal material member is within a range of from 10 to 100.

3. A high smoothness grinding process as claimed in claim 1, wherein the peripheral speed of the grinding wheel is within a range of from 120 to 350 m/s.

4. A high smoothness grinding process as claimed in claim 1, wherein the super abrasive grain grinding wheel comprises abrasive grains having a mean grain size of not smaller than 40 μm.

5. A high smoothness grinding process as claimed in claim 1, further comprising decreasing a cutting speed of the grinding wheel stepwise in the grinding process.

6. A high smoothness grinding process as claimed in claim 1, further comprising a finish grinding step comprising grinding with the grinding wheel the outer peripheral surface of the metal material member at a peripheral speed of the metal material member which is lower than the peripheral speed used in the main grinding process, wherein the finishing grinding step is performed after the main grinding process.

7. A high smoothness grinding process as claimed in claim 6, wherein the peripheral speed of the grinding wheel in the finish grinding step is lower than that of the main grinding step.

8. A high smoothness grinding process as claimed in claim 6, further comprising a spark out step comprising grinding in the condition of no depth of cut by grinding the peripheral surface of the metal material member with the grinding wheel in a condition of no depth of cut, after at least one of the main grinding step or the finish grinding step.

9. A high smoothness grinding process as claimed in claim 1, comprising swinging at least one of the grinding wheel or the metal material member in an axial direction of the metal material member and relative to a direction of cutting of the grinding wheel.

10. A high smoothness grinding process as claimed in claim 1, wherein the super abrasive grain grinding wheel includes abrasive grains of at least one member of the group consisting of CBN and diamond, the abrasive grains having a mean grain size ranging from 60 to 400 μm, and a bonding material capable of producing a vitrified bond.

11. A high smoothness grinding process as claimed in claim 1, further comprising a dressing step comprising flattening the peripheral surface of the grinding wheel.

12. A high smoothness grinding process as claimed in claim 11, wherein the dressing step is carried out using a rotary dresser formed of diamond abrasive grains whose mean grain size is larger than that of the super abrasive grain grinding wheel, wherein the flattening is accomplished in a condition in which a dressing lead in downcut is not larger than 0.1 mm/r.o.w., and a depth of cut is not larger than 5 μm/pass.

13. A high smoothness grinding process as claimed in claim 12, wherein the flattening is accomplished in a condition in which a value of a peripheral speed of the dresser/a peripheral speed of the grinding wheel is within a range of from 0.6 to less than 1.0, a dressing lead in downcut is within a range of from 0.01 to 0.1 mmlr.o .w., and a depth of cut is not larger than 5 μm/pass.

14. A high smoothness grinding process as claimed in claim 11, wherein the dresser is selected from the group consisting of a single stone dresser and a V-type dresser.

* * * * *